US005722899A

United States Patent [19]

Cheng

[11] Patent Number: 5,722,899

[45] Date of Patent: Mar. 3, 1998

[54] METHOD FOR MAKING A MATCHED SET OF GOLF CLUBS UTILIZING FREQUENCY CONVERSION VALUES

[75] Inventor: Michael H. L. Cheng, Simi Valley, Calif.

[73] Assignee: Harrison Sports, Inc.

[21] Appl. No.: 767,348

[22] Filed: Dec. 18, 1996

[51] Int. Cl.[6] ..... A63B 53/00; A63B 53/10

[52] U.S. Cl. ..... 473/289; 473/290

[58] Field of Search ..... 473/289, 287, 473/290, 291

[56] References Cited

U.S. PATENT DOCUMENTS

| | | | |
|---|---|---|---|
| Re. 33,735 | 11/1991 | Rumble et al. . | |
| 2,250,428 | 7/1941 | Vickery . | |
| 3,698,239 | 10/1972 | Everett, III . | |
| 3,984,103 | 10/1976 | Nix . | |
| 4,070,022 | 1/1978 | Braly | 473/289 |
| 4,122,593 | 10/1978 | Braly | 473/289 |
| 4,128,242 | 12/1978 | Elkins, Jr. . | |
| 4,169,595 | 10/1979 | Kaugars . | |
| 4,288,075 | 9/1981 | Kaugars et al. . | |
| 4,415,156 | 11/1983 | Jorgensen . | |
| 4,431,187 | 2/1984 | Rumble et al. . | |
| 4,555,112 | 11/1985 | Masghati . | |
| 4,736,093 | 4/1988 | Braly . | |
| 4,900,025 | 2/1990 | Suganuma . | |
| 5,040,279 | 8/1991 | Braly . | |
| 5,163,681 | 11/1992 | Hodgetts . | |
| 5,351,952 | 10/1994 | Hackman | 473/289 |

FOREIGN PATENT DOCUMENTS 2223951 10/1988 United Kingdom .

*Primary Examiner*—Sebastiano Passaniti
*Assistant Examiner*—Stephen L. Blau
*Attorney, Agent, or Firm*—Oppenheimer Poms Smith

[57] ABSTRACT

Methods of making a set of golf clubs and shafts that are matched according to vibration frequency are disclosed. The methods may include a random selection of shafts from a stock of raw shafts, wherein the vibration frequency of each shaft is determined and then each shaft is assigned a club head number. By determining conversion values based on desired and actual club head weights for each shaft and by determining a value between a desired and measured frequency of each shaft, a total frequency conversion value may be obtained. The total frequency conversion value may then be used to determine an amount to trim each shaft and thereby linearly match each shaft in the set based on vibration frequency and an increase in club head number.

7 Claims, 4 Drawing Sheets

| Iron No. | A Natural Frequency (CPM) | B Desired Frequency (CPM) | C CPM Difference (CPM) (A-B) | D Overage & Weight Difference Conversion Value (CPM) | E Total Frequency Conversion Value (CPM) | F Tip Trim Amount (in) |
|---|---|---|---|---|---|---|
| 2 | 284 | 289 | 5 | 0 | 5 | .25" |
| 3 | 285 | 293 | 8 | 7 | 15 | .83" |
| 4 | 286 | 297 | 11 | 10 | 21 | 1.2" |
| 5 | 288 | 301 | 13 | 18 | 31 | 1.72" |
| 6 | 290 | 305 | 15 | 21 | 36 | 2" |
| 7 | 293 | 309 | 16 | 25 | 41 | 2.3" |
| 8 | 294 | 313 | 19 | 30 | 49 | 2.7" |
| 9 | 296 | 317 | 21 | 39 | 60 | 3.3" |
| P | 299 | 321 | 22 | 40 | 62 | 3.4" |

| Shaft | Frequency (CPMs) | Iron No. |
|---|---|---|
| 1 | 290 | 6 |
| 2 | 286 | 4 |
| 3 | 285 | 3 |
| 4 | 293 | 7 |
| 5 | 294 | 8 |
| 6 | 288 | 5 |
| 7 | 296 | 9 |
| 8 | 284 | 2 |
| 9 | 299 | P |

FIG. 1

| Weight (g) | CPM Equivalent (CPMs) |
|---|---|
| 2 | 1 |
| 4 | 3 |
| 6 | 4.5 |
| 7 | 5 |

FIG. 2

| No. of Iron | A Desired Weight (g) | B Actual Weight (g) | C Under-age (g) | D Weight Pin for underage (g) | E Overage (g) | F Overage Conver-sion Value (CPM) | G Weight Differ-ence Conver-sion Value (CPM) | H Overage & Weight Difference Conversion Value (CPM) |
|---|---|---|---|---|---|---|---|---|
| 2 | 235 | 230 | 5 | 5 | | 0 | 0 | 0 |
| 3 | 242 | 245 | | | 3 | 2 | 5 | 7 |
| 4 | 249 | 248 | 1 | 1 | | 0 | 10 | 10 |
| 5 | 256 | 260 | | | 4 | 3 | 15 | 18 |
| 6 | 263 | 265 | | | 2 | 1 | 20 | 21 |
| 7 | 270 | 267 | 3 | 3 | | 0 | 25 | 25 |
| 8 | 277 | 275 | 2 | 2 | | 0 | 30 | 30 |
| 9 | 284 | 289 | | | 5 | 4 | 35 | 39 |
| P | 291 | 287 | 4 | 4 | | 0 | 40 | 40 |

FIG. 3

| (A) Tip Trim (in) | (B) Increase in Frequency (CPM) |
|---|---|
| 1" | 18 |
| 1/4" | 4.5 |

FIG. 4

| Iron | A Flex | R Flex | F Flex |
|---|---|---|---|
| 2 | 279 | 289 | 299 |
| 3 | 283 | 293 | 303 |
| 4 | 287 | 297 | 307 |
| 5 | 291 | 301 | 311 |
| 6 | 295 | 305 | 315 |
| 7 | 299 | 309 | 319 |
| 8 | 303 | 313 | 323 |
| 9 | 307 | 317 | 327 |
| P | 311 | 321 | 331 |

FIG. 5

| Iron No. | A Natural Frequency (CPM) | B Desired Frequency (CPM) | C CPM Difference (CPM) (A-B) | D Overage & Weight Difference Conversion Value (CPM) | E Total Frequency Conversion Value (CPM) | F Tip Trim Amount (in) |
|---|---|---|---|---|---|---|
| 2 | 284 | 289 | 5 | 0 | 5 | .25" |
| 3 | 285 | 293 | 8 | 7 | 15 | .83" |
| 4 | 286 | 297 | 11 | 10 | 21 | 1.2" |
| 5 | 288 | 301 | 13 | 18 | 31 | 1.72" |
| 6 | 290 | 305 | 15 | 21 | 36 | 2" |
| 7 | 293 | 309 | 16 | 25 | 41 | 2.3" |
| 8 | 294 | 313 | 19 | 30 | 49 | 2.7" |
| 9 | 296 | 317 | 21 | 39 | 60 | 3.3" |
| P | 299 | 321 | 22 | 40 | 62 | 3.4" |

FIG. 6

METHOD FOR MAKING A MATCHED SET OF GOLF CLUBS UTILIZING FREQUENCY CONVERSION VALUES

BACKGROUND OF THE INVENTION

1. Field of the Invention

The present invention relates to a method for making a set of golf clubs wherein each club is matched to the set according to certain club characteristics. The present invention particularly relates to a method for making a set of golf clubs wherein each club is matched to the set according to vibration frequency.

2. Prior Art and Related Information

Golf is a demanding game that challenges the ability of each player. As is a common occurrence in most sports, creative individuals have attempted to enhance the performance of golfers by improving the sports equipment they use. In the case of golf, a typical pursuit of golf club manufacturers is to improve the feel and control of the golf clubs.

Since golf is played with a number of golf clubs, each of which is carefully selected for a given type of playing circumstance, any variation in the feel and control from one club to the next is likely to affect the golfer's performance. For example, in a typical set of golf clubs which includes three wood drivers and eight irons, the drivers are used to achieve long distance travel of the golf ball and the irons are used to accurately place the golf ball as close to the pin as possible after a long drive. The drivers typically have long shafts, while the irons decrease in shaft length as the head number increases. Moreover, with increasing head number, the club head is configured to give the golf ball more loft and less distance. It is therefore evident that a golfer needs to experience consistent feel and control from one club to the next to ensure consistent impact and proper placement of the golf ball during a round of golf.

One way of advancing the goal of having a consistent feel and control from one club to the next within a set of clubs is to ensure that when the set of clubs is created, each club is matched to the next club by a certain physical characteristic of the club shaft. One particularly popular characteristic useful for this purpose is the vibration frequency of the golf club shaft which vibration frequency is typically defined as the oscillation in cycles per minute (CPM) of a shaft when it is clamped at its butt end in a cantilever fashion and the tip of the shaft has been pulled and released. Specifically, many golfers have found that a greater consistency in feel and control within a set of golf clubs is obtained when the vibration frequency of each shaft increases with increasing club head number. It is sometimes preferred that the vibration frequency increases linearly with increasing club head number and sometimes it is preferred that vibration frequency increase linearly with decreasing shaft length (i.e., shaft length decreases with increasing club head number).

A number of methods for creating a matched set of golf clubs according to vibration frequency have been formulated in the past. U.S. Pat. Nos. 4,070,022 and 4,122,593 to Braly; U.S. Pat. No. 5,163,681 to Hodgetts; U.S. Pat. No. 4,128,242 to Elkins, Jr.; U.S. Pat. No. 4,555,112 to Masghati; and U.S. Pat. No. 4,900,025 to Suganuma each relate to such methods. However, known methods for such frequency matching often include such highly selective criterion in choosing a particular shaft from existing stock that stock is potentially wasted or must be deemed scrap. In addition, the selection process proves so labor intensive that costs of manufacture are often prohibitively high. Finally, the time required for such a selection process inevitably lengthens the manufacturing process.

SUMMARY OF THE INVENTION

In view of the foregoing, it is an object of the present invention to provide a method of manufacturing a matched set of golf clubs with reduced costs and reduced delays without compromising the desired consistent feel and control among the golf clubs within the set.

It is a further object of this invention to provide a method of manufacturing a set of golf clubs which are matched by vibration frequency and particularly where each club has a vibration frequency which is linearly related to the club head number.

In accordance with the present invention, a method is provided for making a matched set of golf clubs. The method may include the steps of randomly selecting a plurality of raw shafts from a stock of raw shafts and then determining the vibration frequency of each of the plurality of shafts. The shafts are then assigned a club head number according to the frequency of each shaft starting with the lowest club head number being assigned to the shaft having the lowest vibration frequency. A desired club head weight for each shaft is selected and then a weight difference conversion value is determined to adjust the determined vibration frequency of each shaft based on the desired club head weight.

In the event the actual club head weight is greater than the desired club head weight, an overage conversion value is determined. Next, a desired frequency is selected for each club within the set so that the vibration frequency of each club in the set will increase linearly with increasing club head number. In fact, because as each club head number increases, the length of each shaft decreases, it is preferably desired that the vibration frequency of each golf club increase linearly with decreasing golf club shaft length.

After the desired vibration frequency has been selected, and the determined vibration frequency has been determined by testing, the total frequency conversion value is calculated by adding (1) the weight conversion value, (2) the overage difference conversion value, and (3) the number determined by subtracting the determined vibration frequency from the desired vibration frequency. Based on the total frequency conversion value, a tip trim amount is determined, and the tip of the shaft is then trimmed by said tip trim amount. After the tip is properly trimmed, the butt is also trimmed to achieve the desired length. Because the shaft was vibration-tested by clamping the shaft ahead of the butt, the trimming of the butt has no effect on the shaft's vibration frequency.

Also note that, although this process has been described with a particular vibration frequency relationship between the shafts in a set of clubs, this process can be performed to achieve any desired frequency characteristic for a single golf club or a set of golf clubs. A set of golf clubs is defined as any three or more golf clubs with different club head numbers.

BRIEF DESCRIPTION OF THE DRAWINGS

The objects, features and advantages of the present invention will be apparent to one skilled in the art from reading the following detailed description and the following figures:

FIG. 1 is a chart listing exemplary vibration frequency values for nine randomly selected shafts;

FIG. 2 is a chart listing data that identifies the effect of incremental head weight differences on the vibration frequency of a particular shaft;

FIG. 3 is a chart listing data for calculating the overage and weight difference conversion values based on actual and desired weights for a club head for each shaft listed in FIG. 1;

FIG. 4 is a chart listing data that identifies the effect of trimming the tip of a shaft of FIG. 1 on its vibration frequency;

FIG. 5 is a chart listing exemplary desired vibration frequency values for three sets of golf clubs having relatively different stiffnesses; and, FIG. 6 is a chart listing data for calculating a total frequency conversion value for each shaft and for determining the tip trim amount necessary to create in each shaft of FIG. 1 the desired vibration frequency.

DETAILED DESCRIPTION OF THE INVENTION

The following description describes a method for the creation of a matched set of golf clubs wherein the vibration frequency of each golf club in the set increases with increasing club head number. In its preferred embodiment, the method of this invention is practiced with graphite golf club shafts which are made by known methods of wrapping pre-cut graphite sheets around a mandrel.

Typically, the shafts are made to include a relatively thin tip portion, a relatively larger butt portion and an intermediate tapered portion which joins the tip portion and the butt portion. The use of the mandrel results in a shaft having an opening passing through the shaft.

A conventional set of matched clubs typically includes one to three wood drivers, eight irons, a pitching wedge, a sand wedge and a putter. Although the method of the present invention is applicable to the manufacture of all of these types of clubs, the description below is directed to matching a set of irons (numbered two through nine) and a pitching wedge. As such, the description is merely exemplary and does not limit the utility of the invention in any way.

In an initial step, nine different raw shafts are randomly selected from a stock of shafts and then tested to determine the weighted frequency of each shaft. The frequency is measured by known methods which include securing the butt end of the shaft in place at a stationary location and fastening a predetermined test weight at the tip end of the shaft. The shaft is then excited and the resulting oscillations are measured to determine the weighted frequency (in cycles per minute or "CPM"). In a preferred embodiment, the predetermined test weight is 235 grams for irons, which is typically the weight of a two-iron head, and 200 grams for woods which is typically the weight of a driver head.

Upon obtaining the frequency of the nine randomly selected raw shafts, each shaft is then assigned a club head number (in this case the head numbers range from a two iron through pitching wedge, inclusive) starting with the shaft having the lowest vibration frequency and ending with the shaft having the highest vibration frequency. That is, the lowest frequency shaft will be assigned the two-iron designation and the highest frequency shaft will be assigned the pitching wedge designation. The intermediate shafts will similarly be assigned a head number depending upon the increasing vibration frequency of each shaft. To avoid later confusion, each of the nine shafts should be clearly labeled with its club head designation.

By way of example, FIG. 1 shows the measured vibration frequency values of nine randomly selected raw shafts (left and middle column). In addition, FIG. 1 shows the assignment of iron head number designations (right column) starting from the shaft with the lowest vibration frequency (shaft number eight) and ending with the highest (shaft number nine).

The next step is to select the club heads which will be attached to each respective shaft and to weigh each club head to determine their actual weight.

Following the assignment of a club head designation to each shaft, the next step is to determine the effect on vibration frequency, if any, that the weight of the later-attached club head will have on each shaft. This determination is needed because the vibration frequency of the shafts were all initially measured using a typical two-iron club head weight (235 grams) whereas the ultimate actual club head weight, at least for the three-iron through pitching wedge clubs, will incrementally increase from that value as head number increases. Presently, it is customary for club heads to increase in weight by 7 grams for each increase in club number, and it is known that as club head weight increases, the shaft vibration frequency will decrease.

To perform this calculation, it is first necessary to obtain weight vs. frequency (CPM) data to show the relationship between an increase in head weight to a reduction in shaft frequency. To obtain this data, frequency testing of a representative shaft is performed using incremental test weights. An example chart containing such data is shown in FIG. 2 wherein a representative iron graphite shaft was frequency tested using test weights of 2, 4, 6, and 7 grams.

Once weight increase vs. frequency reduction data has been obtained, it is next necessary to equate the change in club head weight to a decrease in shaft frequency. In that connection, reference is made to the chart provided in FIG. 3.

In Column A, the desired weight of each club head, two-iron through pitching wedge, is listed. The desired weights in FIG. 3 are exemplary and will be determined by the needs of the manufacturer; however, in this example, the desired weight of each club head increases incrementally by seven grams from the typical 235 gram, two-iron club head. From the data in FIG. 2, it is then extrapolated that each seven gram increase over the 235 gram two-iron head weight will lead to approximately a five CPM decrease in shaft frequency. Accordingly, the needed increase in shaft frequency for each desired club head weight is listed in Column G of FIG. 3.

Next, it is necessary to determine the effect on shaft frequency of the deviations in weight between the desired club head weight and the actual club head weight for each shaft. From this information, the overall adjustment due to club head weight to the measured frequency can then be determined. If the actual weight is below the desired weight, a weight pin, lead tape, lead powder, or other supplemental means of increasing weight, will be introduced to increase the actual weight to the desired weight. If the actual weight is greater than the desired weight, it must then be determined by how much the additional weight will further reduce shaft frequency. In that connection, reference is again made to FIGS. 2 and 3.

In Column B of FIG. 3, the actual weight of the club head that will be attached to each shaft is listed. These weights are determined using conventional weighing methods. If the actual weight is less than the desired weight, an underage is thereby identified. In FIG. 3 this value is listed in Columns C and D, Column C thereby identifies the underage in weight and Column D thereby identifies how much supplemental weight must be added. In lieu of a weight pin, lead powder or lead tape can be used in the conventional manner to supplement the weight of the head. If the actual weight is greater than the desired weight, an overage is thereby identified. In FIG. 3, the overage is listed in Column E.

In those instances where a weight underage exists, the addition of supplemental weight will bring the weight of the club head to the desired weight as listed in Column A. Consequently, the only adjustment to the frequency of the shaft will be the adjustment required by the previously discussed incremental weight increase in the desired club head weight for each shaft. As also previously discussed, these adjustments are listed in Column G.

In those instances where a weight overage exists, however, an additional frequency compensation is necessary. That additional frequency compensation is obtained by comparing the overage with a decrease in frequency value according to the data of the chart of FIG. 2. The resulting overage conversion value for each shaft having an overage in the example of FIG. 3 is listed in Column F.

Finally, to obtain the frequency adjustment required for each shaft due to actual club head weight, the conversion value resulting from the incremental increase in desired club head weight and the conversion value resulting from an actual club head weight in excess of the desired club head weight are then added together to arrive at an overage and weight difference conversion value. In FIG. 3, the overage and weight difference conversion value due to actual club head weight for each shaft is listed in Column H.

Now that the overage and weight difference conversion value is obtained, it remains to determine the amount each shaft must be trimmed to achieve the desired frequency for each club. A number of preliminary steps, however, must be performed. First it is necessary to determine the relationship between tip trimming and an increase in shaft frequency. Next it is necessary to select the desired frequency for each shaft that will comprise the set. Then, the difference between the desired frequency and the actual frequency as adjusted for club head weight must be calculated.

The increase in shaft frequency resulting from tip trimming will depend directly upon the type of shafts being manufactured and the material properties of such shafts. By way of example only, a graphite shaft of the preferred embodiment has been determined to have the tip to frequency relationship embodied by the data in FIG. 4. The first column shows the tip trim in inches and the second column shows the resulting increase in shaft frequency in cycles per minute.

The tip-to-frequency relationship can be determined by selecting a representative shaft and incrementally trimming the tip and measuring the new frequency, and thus determining the increase in frequency resulting from the tip being trimmed. An alternative method of determining this relationship is, rather than actually trimming the tip of a representative shaft, to move the shaft incrementally further into the frequency analyzer, thus simulating a shorter shaft. This method will permit a large number of incremental testing, avoid destruction of a shaft, and permit testing of the actual shaft to be used in making the golf club.

As for the desired frequency for each shaft comprising the set, FIG. 5 is a chart showing exemplary desired frequencies (in CPM) for iron nos. 2 through 9 and a pitching wedge. For each of the irons and for the pitching wedge, FIG. 5 further includes exemplary frequencies for shafts of different flex designations. Conventionally, flex designation "A" signifies a semiflexible shaft, designation "R" signifies a regular shaft, and designation "F" signifies a firm or stiff shaft. In FIG. 5, the frequency increases by four CPM with each incremental increase in club head number. It is understood, however, that the frequency values in FIG. 5 are only samples of desired frequencies and that the desired frequency for any particular set of clubs will depend on the needs and criteria of the manufacturer.

As for the difference between the desired frequency and the actual frequency as adjusted for club head weight, a comparison is first made between the desired frequency and the frequency initially measured for each shaft (using the predetermined weight). In that connection, Column A of FIG. 6 lists the frequencies initially measured in the example of FIG. 1, and Column B lists the desired frequency for each shaft as the frequency for a "R" flex shaft (See also FIG. 5). The difference between the actual and desired frequencies is then calculated. This value is listed in FIG. 6 at Column C. Added to this difference is the overage and weight difference conversion, value, which is listed in FIG. 6 at Column D (See also FIG. 3 at Column H) to arrive at the Total Frequency Conversion Value in CPM between the shaft as selected from stock and the shaft as ultimately desired. This Total Frequency Converison Value is listed in FIG. 6 at Column E.

The Total Frequency Conversion Value as finally obtained is then compared to the data for tip trimming which is exemplified in FIG. 4. For the preferred embodiment, the Total Frequency Conversion Value is divided by eighteen CFM with the resulting quotient being the amount, in inches, that the tip should be trimmed to obtain the desired frequency. In FIG. 6, this tip trim amount is listed in Column F.

To complete the process of manufacturing the set of frequency matched shafts, each shaft will be trimmed by the calculated amount, thereby resulting in a set of shafts in which the shaft vibration frequencies have the desired relationship to club head number. In addition, any supplemental weight necessary to adjust the club head weight will have been added to the club head, the club head will be attached to its assigned shaft and any other finishing aspects of assembly as commonly practiced in the manufacture of golf clubs will be performed.

Finally, the butt will be trimmed by the necessary amount to achieve the desired club length for the club head number. However, so long as the amount of butt which is removed is less than the amount which extended beyond the clamped portion of the shaft during the vibration testing, the vibration frequency of the shaft will not be affected.

By following the above described steps for a random selection of shafts from stock, it is seen that the manufacturer can easily and efficiently obtain a frequency matched set of golf clubs and thereby better ensure a consistent feel and control to the user from one club to the next. This method also reduces the likelihood of shaft stock being scrapped and reduces the labor, delay and expense incurred in current methods.

Although the present invention has been described with reference to preferred embodiments, workers skilled in the art will recognize that changes may be made without departing from the spirit and scope of the invention.

What is claimed is:

1. A method of making a matched set of golf clubs comprising the steps of:

randomly selecting a plurality of shafts from a stock of raw shafts;

determining the weighted vibration frequency of each of the plurality of shafts;

assigning sequential club head numbers to each shaft in the order of the frequency of each shaft, starting with the lowest club head number being assigned to the shaft having the lowest vibration frequency;

selecting a club head for each respective shaft;

determining the actual weight of each club head;

selecting a desired club head weight for each shaft;

determining a weight difference conversion value to adjust the determined vibration frequency of each shaft based on the desired club head weight;

determining an overage conversion value to adjust the determined vibration frequency of each shaft based on the actual weight of a selected club head in excess of the desired club head weight;

determining for each shaft a total frequency conversion value comprising the addition of (a) said weight difference conversion value, (b) the overage conversion value, and (3) the difference between the desired vibration frequency (minuend) and the determined vibration frequency (subtrahend);

determining for each shaft a tip trim amount based on the total frequency conversion value; and trimming the tip of each shaft by said determined tip trim amount.

2. A method in accordance with claim 1, wherein said step of determining a weight difference conversion value is obtained by frequency testing a representative shaft to obtain conversion data showing the relationship between increasing club head weight to decreasing vibration frequency for said representative shaft, and then by correlating said desired club head weight to a decrease in vibration frequency from said conversion data to thereby obtain said weight difference conversion value.

3. A method in accordance with claim 2, wherein said step of determining an overage conversion value includes measuring the actual weight of a selected club head, determining any excess in the weight of said selected club head from said desired club head weight, and correlating said excess to a decrease in vibration frequency from said conversion data to thereby obtain said overage conversion value.

4. A method in accordance with claim 3, wherein said step of determining a tip trim amount includes formulating for a representative shaft trim conversion data setting forth a relationship between tip trim amount and a resulting increase in vibration frequency, and correlating said total frequency conversion value with said trim conversion data to obtain said tip trim amount.

5. The method of claim 4 wherein said trim conversion data is formulated by using a frequency analyzer which clamps the shaft near its butt and incrementally moving the shaft into the analyzer for each test to simulate shorter shafts.

6. A method in accordance with claim 1, further comprising the steps of supplementing the actual weight of a selected club head which is less than said desired club head weight by providing supplemental weight which is substantially equal to the difference between said selected club head weight and said desired club head weight.

7. A set of golf clubs which are produced by utilizing a method comprising the steps of:

randomly selecting a plurality of shafts from a stock of raw shafts;

determining the weighted vibration frequency of each of the plurality of shafts;

assigning sequential club head numbers to each shaft in the order of the frequency of each shaft, starting with the lowest club head number being assigned to the shaft having the lowest vibration frequency;

selecting a club head for each respective shaft;

determining the actual weight of each club head;

selecting a desired club head weight for each shaft;

determining a weight difference conversion value to adjust the determined vibration frequency of each shaft based on the desired club head weight;

determining an overage conversion value to adjust the determined vibration frequency of each shaft based on the actual weight of a selected club head in excess of the desired club head weight;

determining for each shaft a total frequency conversion value comprising the addition of (a) said weight difference conversion value, (b) the overage conversion value, and (c) the difference between the desired vibration frequency (minuend) and the determined vibration frequency (subtrahend);

determining for each shaft a tip trim amount based on the total frequency conversion value; and trimming the tip of each shaft by said determined tip trim amount.

* * * * *